US008413729B2

(12) United States Patent
Varan

(10) Patent No.: US 8,413,729 B2
(45) Date of Patent: Apr. 9, 2013

(54) APPARATUS AND METHOD FOR CAPPING AN UNDERWATER OIL WELL

(76) Inventor: Cyrus O. Varan, Orewa (NZ)

( * ) Notice: Subject to any disclaimer, the term of this patent is extended or adjusted under 35 U.S.C. 154(b) by 288 days.

(21) Appl. No.: 12/843,936

(22) Filed: Jul. 27, 2010

(65) Prior Publication Data

US 2012/0006568 A1 Jan. 12, 2012

Related U.S. Application Data

(60) Provisional application No. 61/344,352, filed on Jul. 6, 2010.

(51) Int. Cl.
*E21B 34/04* (2006.01)

(52) U.S. Cl.
USPC ..... 166/378; 166/363; 166/364

(58) Field of Classification Search ..... 166/94.1, 166/93.1, 379, 363, 364, 51, 378; 405/60
See application file for complete search history.

(56) References Cited

U.S. PATENT DOCUMENTS

| | | | | |
|---|---|---|---|---|
| 1,807,498 | A * | 5/1931 | Teed | 166/95.1 |
| 1,859,606 | A * | 5/1932 | Sievern et al. | 166/79.1 |
| 4,318,442 | A * | 3/1982 | Lunde et al. | 166/357 |
| 4,323,118 | A * | 4/1982 | Bergmann | 166/96.1 |
| 4,324,505 | A * | 4/1982 | Hammett | 405/60 |
| 4,741,395 | A | 5/1988 | Reed et al. | |
| 8,025,103 | B1 * | 9/2011 | Wolinsky | 166/364 |
| 2011/0311311 | A1 * | 12/2011 | Brey | 405/60 |

FOREIGN PATENT DOCUMENTS

| | | |
|---|---|---|
| DE | 2933032 | 2/1981 |
| FR | 2676088 | 11/1992 |

OTHER PUBLICATIONS

Hotchkiss, David, "Search and Examination Report," for Application No. GB1102297.7, dated Mar. 15, 2011, Intellectual Patent Office of the United Kingdom, South Wales, United Kingdom.

Hotchkiss, David, "Patent Act 1977: Search Report under Section 17", for corresponding application GB1102297.7, dated Mar. 11, 2011.

* cited by examiner

*Primary Examiner* — Nicole Coy
(74) *Attorney, Agent, or Firm* — Woods Oviatt Gilman LLP

(57) ABSTRACT

An apparatus and method for the creation of an impermeable pile in the vicinity of a dysfunctional oil well are provided. The impermeable pile is sealed and impervious to sea water and of sufficient strength to sustain the oil pressure to prevent oil leakage into the sea. The impermeable pile is configured for receiving oil from the well and discharging oil through a pipe leading to the surface.

20 Claims, 1 Drawing Sheet

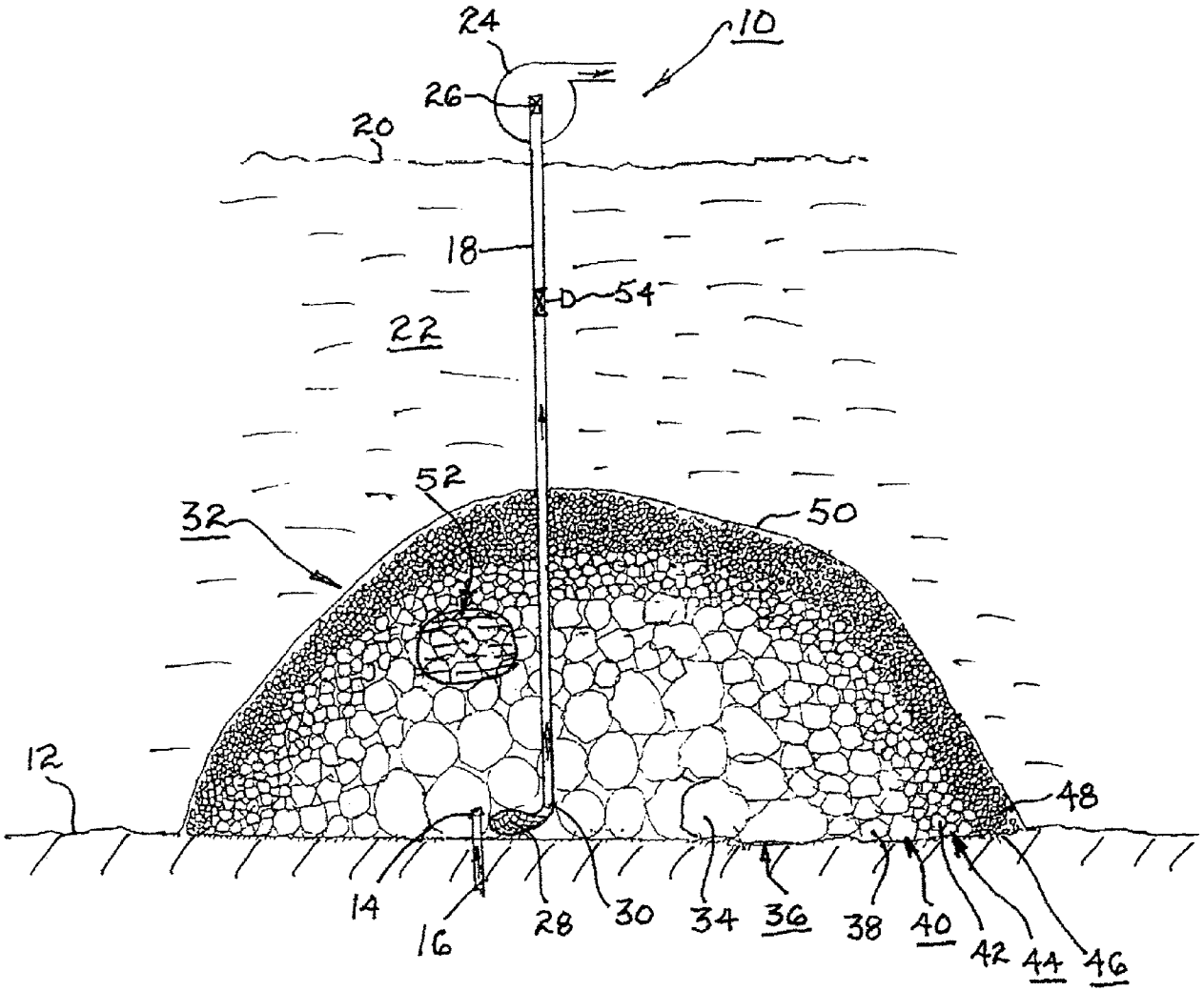
10
24
26
18
54
20
22
50
52
32
12
14
16
28
30
34
36
38
40
42
44
46
48

APPARATUS AND METHOD FOR CAPPING AN UNDERWATER OIL WELL

RELATIONSHIP TO OTHER APPLICATIONS AND PATENTS

This application claims the benefit of U.S. Provisional Patent Application Ser. No. 61/344,352, filed Jul. 6, 2010.

TECHNICAL FIELD

The present invention relates to underwater drilling of oil wells in fresh or salt water (referred to herein collectively as "sea"); more particularly, to methods for dealing generally with an oil well exhibiting uncontrolled flow into the sea; and most particularly, to a method and apparatus for capping such a well to stop leakage into the sea whilst optionally continuing to produce crude oil from the well.

BACKGROUND OF THE INVENTION

In petroleum exploration and production, it is well known to drill for oil in a sub-sea environment. It is also known that during drilling or production, unanticipated pressure surges may occur at the well head, leading to an uncontrolled flow condition known in the art as a "blow-out" wherein flow control of the emerging crude oil is lost. Such blow-outs are costly at least in terms of lost time and production; and when a blow-out continues for an extended period of time or in very deep water, as has been seen recently in the BP blow-out incident in the Gulf of Mexico on Apr. 20, 2010, the environmental and financial consequences can be catastrophic.

Typically, wells that are drilled on land or underwater are drilled through a generally cylindrical safety device mounted at the well head known as a "blow-out preventer" (BOP). A typical BOP includes a compressible collar that can be clamped about a drill stem to seal the well should a potential blow-out occur with the drill stem in place, and further includes a plurality of redundant valves that can be closed to shut off a blow-out or other leakage from a producing or exhausted well. However, in blow-out instances wherein no BOP was employed or wherein the BOP was inoperative, additional control is required. For land-based drilling operations, it is well known to seal a blown-out well with heavy equipment and/or explosives. For underwater blow-outs, these options are not generally available, especially in very deep water where all remediation must be conducted remotely, in darkness, and at greatly elevated pressures.

What is needed in the art is a simple method and apparatus to shut off uncontrolled flow of crude oil from an underwater oil well, preferably to allow continued production to the sea surface from the well.

It is a principal object of the present invention to stop the uncontrolled flow of crude oil from an underwater oil well into the surrounding sea environment.

It is a further object of the invention to capture and recover crude oil continuing to flow from the well.

SUMMARY OF THE INVENTION

Briefly described, in accordance with the present invention an apparatus and method for capping an underwater oil well comprises a pipe equipped with a pervious collection head extending from the vicinity of the oil well head to the sea surface. Optionally, the pipe may be further equipped with a pump for lifting oil collected by the pervious collection head from the well head to a point of controllable discharge at the sea surface.

A pile of objects, which may be rocks or metals, or combinations thereof, is disposed around the pervious collection head and the lower end of the pipe. In a presently preferred embodiment, a mix of smaller objects is disposed on and around larger objects, forming a first canopy. Still a mix of smaller objects is disposed on and around the first canopy to form a second canopy. A plurality of additional canopies of progressively smaller objects, such as for example, smaller boulders, cobbles, pebbles, granules, and sand are disposed in substantially concentric layers about the second canopy, defining a graded pile. A mixture of cement that is settable under water may be included in one or more of the successive canopy mixes. An impermeable membrane may be included within or on the outer surface of the graded pile. The size and weight of the graded pile is sufficient to prevent leakage of oil to the sea. The entire flow from the well head thus may be drawn through the pipe by the optional pump, or the well may be shut in by closing one or more valves in the flow path.

BRIEF DESCRIPTION OF THE DRAWINGS

The present invention will now be described, by way of example, with reference to the accompanying drawing, in which:

FIG. 1 is an elevational cross-sectional view (not to scale) of a presently preferred embodiment of an apparatus for capping an underwater oil well in accordance with the present invention.

The exemplification set out herein illustrates one preferred embodiment of the invention, in one form, and such exemplification is not to be construed as limiting the scope of the invention in any manner.

DESCRIPTION OF THE PREFERRED EMBODIMENTS

Referring to FIG. 1, an apparatus 10 in accordance with the present invention is shown resting on the sea floor 12 and surrounding the well head 14 of an oil well 16. Apparatus 10 comprises a pipe 18 extending from the vicinity of well head 14 at a first end to a point of controllable discharge, such as above the surface 20 of the sea 22, at a second end. Optionally, a pump 24 is coupled to pipe 18 and shown at the upper pipe end 26 but may be installed anywhere in pipe 18 in accordance with the invention. A pervious collection head 28 may be connected to the lower pipe end 30 in proximity to well head 14. A pile 32 of objects surrounds well head 14, pervious collection head 28, and the lower portion of pipe 18. Preferably, pile 32 is graded in size with the largest objects 34 emplaced first to form a core pile 36, then smaller objects 38 emplaced in a first canopy 40 over and around pile 36, then still smaller objects 42 emplaced in a second canopy 44 over and around first canopy 40. A plurality of additional canopies, exemplified by a third canopy 46, may be emplaced sequentially in the same fashion, terminating in a canopy of finest objects 48. The number of canopies, the progressive gradation in size of the objects, and the relative size of the objects may be varied at will within the scope of the present invention. Optionally, one or more impermeable membranes 50 may be incorporated in pile 32, either on the outside as shown in FIG. 1, or internally between successive canopies.

In a presently preferred embodiment, at least some of objects 34,38,42,48 are formed of rock, metals, or other suitable materials. Preferred sizes of progressive canopy objects are selected from the group consisting of boulders, cobbles, pebbles, granules, and sand in accordance with the internation Wentworth scale of sizes. It will be seen that as additional canopies are formed, the newly-emplaced smaller objects will settle into some of the interstices of the previous canopy, thereby partially blocking oil flow and creating additional desirable pressure drops to inhibit oil flow radially through pile 32 and to help redirect the flow of oil upward through pipe 18 toward surface 20.

Optionally, wet concrete 52 may be included within pile 32 during construction thereof to fill interstices and further reduce the permeability of pile 32. Optionally, a choke valve 54 may be included at an appropriate location along pipe 18 to eventually cut off the flow of oil upward through pipe 18, if so desired.

As successive canopies are added to form pile 32, the pile creates an increasing back pressure of oil in the immediate vicinity of well head 14 and pervious collection head 28. Preferably, optional pump 24 is energized during construction of pile 32 to remove at least a part of the oil flowing from well head 14, along with surrounding sea water, thereby reducing any tendency for oil to flow radially through or around pile 32 before construction of the pile is finished. Preferably, the capacity of optional pump 24 and the size of pipe 18 are selected to be able to pump at the flow rate of oil flowing from well head 14.

The following description is believed to explain the basis for success of the present invention in capping an undersea oil well.

Pipe 18 is necessary for apparatus 10 to function successfully. Initially during construction, pipe 18 is placed near well head 14. Without anything further being done, oil will continue to spew uncontrolled from the well head to the surface 20; and some of the oil may rise by density difference to the surface through pipe 18. Placement of large objects 34, such as boulders, around well head 14 and pipe 18 begins to create some back pressure above the well head such that pipe 18 offers a path of lesser resistance for the oil to flow. Some oil will flow up pipe 18 but most of the oil will continue to flow around the large-size objects 34 during the initial stages of build of pile 32. As more canopies of smaller-sized objects are added on top of the larger objects, more back pressure is created around the well head and more of the oil will flow through the pipe as the path of less resistance. Eventually, as more and more objects of even smaller size are place on the pile 32, most of the oil will flow through pipe 18 because of the increased back pressure through pile 32 and, if necessary, the operation of pump 24. At that point, if pipe 18 were choked off (i.e., dead-headed), the pressure inside pile 32 will eventually equal the pressure at the well head and, unless pile 32 is made essentially impermeable, oil will again begin seeping out through pile 32 uncontrollably.

However, if pile 32 can be made impermeable, the pile by itself can stop the oil leakage without resort to optional pump 24. That is, pipe 18 may be closed off entirely thereby sealing the well. Cement mixed with the objects, or a membrane of plastic or rubber of sufficient thickness, can help to make the pile monolithic and impermeable. If a cement is used, it can be added during application of subsequent layers of objects when the pipe 18 is capable of carrying a sufficient amount of the well head flow in the pile. Until pile 32 is made impermeable, the vent pipe may need an optional choke valve 54. The valve may remain open during the early stages of object piling; then, as the pile becomes less permeable with the additional of smaller objects and with setting of the cement, pipe 18 may be gradually choked off. If pile 32 can contain the full pressure of well head 14, the pipe 18 may be choked off completely, thereby shutting off the flow of oil from the well in accordance with the primary object of the present invention. If some leakage remains through pile 32, valve 54 may be re-opened and oil pumped to the surface so that no oil flows through pile 32. This may continue until the well itself is tapped down by the vent pipe to a head pressure that pile 32 can accommodate with pipe 18 closed, until another well head can be installed into the existing well or until pile 32 can be made impermeable. Alternatively, the well may be placed into production through pipe 18, thereby reducing the well head pressure and forestalling further leakage through pile 32 into the sea.

Whether pile 32 has been made impermeable can be determined by a simple calculation based on measurable factors such as the oil pressure at the well head, the depth of the water, and the oil pressure at the top of the pipe.

A method in accordance with the present invention for capping an underwater oil well comprises the steps of:

a) providing a pipe extending from the immediate vicinity of the well head to the surface; and b) forming a pile of objects resting on the sea floor and surrounding the lower end of the pipe, wherein the pile is graded in size and weight of the objects progressively outward from the well head, the largest of the objects being placed nearest the well head and the smallest of the objects being placed farthest from the well head.

The method may comprise the further step of shutting off oil flow through the pipe when the pile has been made impermeable enough to offset the oil pressure at the well head.

The method may also comprise the further step of passing oil through the pipe during and after completion of construction of the pile.

It is believed that by providing a thick impermeable layer at the top-side of the pile, a large surface area is provided to oppose the pumping pressures at the well head.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An apparatus for controlling the flow of oil from an oil well, the apparatus comprising:

a) a pipe extending from the immediate vicinity of a well head to a point of controlled discharge, said pipe comprising a first end and a second end opposite said first end and proximate said point of controllable discharge;

b) an impermeable pile of objects, wherein said pile of objects comprises a first and second canopy of objects, wherein said first canopy of objects is configured to be permeable and surrounds said first end of said pipe, wherein said first end of said pipe extends into said first canopy of objects, and wherein said second canopy of objects is permeable and positioned outward from said first canopy of objects and is configured to be less permeable than said first canopy of objects.

2. An apparatus in accordance with claim 1 wherein at least some of said objects comprises boulders.

3. An apparatus in accordance with claim 1 wherein at least some of said objects comprises metals.

4. An apparatus in accordance with claim 1 further comprising a pervious collection head disposed in proximity to said well head and attached to said first end of said pipe.

5. An apparatus in accordance with claim 1 further comprising a pump disposed in said pipe.

6. An apparatus in accordance with claim 5 wherein said pump is disposed in said pipe proximate said point of discharge.

7. An apparatus in accordance with claim 1 further comprising a choke valve disposed in said pipe.

8. An apparatus in accordance with claim 1 further comprising a membrane disposed in or on said pile of objects.

9. An apparatus in accordance with claim 1 further comprising cement emplaced as a wet cement matrix during construction of said pile of objects.

10. An apparatus in accordance with claim 1 wherein said pile of objects is graded in size and weight of said objects progressively outward from said well head, the larger and heavier of said objects being generally placed nearer said well head and the smaller and lighter of said objects being generally placed farther from said well head.

11. An apparatus in accordance with claim 10 wherein the size of said objects ranges in a series including boulders, cobbles, pebbles, granules, and sand.

12. An apparatus in accordance with claim 1 wherein the size of said pile of objects is configured to offset the pressure difference between a pressure within said well head and a pressure immediately outside said well head.

13. An apparatus in accordance with claim 1 wherein said second canopy is immediately adjacent said first canopy.

14. A method for controlling the flow of oil from an oil well, comprising the steps of:

a) utilizing a pipe including a first end and a second end;

b) employing said first end of said pipe in the immediate vicinity of the well head to and said second end of said pipe at a point of controllable discharge;

c) forming a first canopy of objects configured to be permeable and surrounding said first end of said pipe, said first end of said pipe extending into said first canopy; and d) forming a second canopy of objects positioned outwardly from said first canopy of objects to form a pile of objects, wherein said second canopy is permeable, and wherein said pile of objects is impermeable.

15. A method in accordance with claim 14 wherein said pile of objects is graded in size and weight of said objects progressively outward from said well head, the larger of said objects being placed nearer said well head and the smaller of said objects being placed farther from said well head.

16. A method in accordance with claim 14 further comprising the step of shutting off oil flow through said pipe when said pile of objects has been made large enough to offset the oil pressure at said well head.

17. A method in accordance with claim 14 further comprising the step of passing oil through said pipe during and after construction of said pile of objects.

18. A method in accordance with claim 14 further comprising providing a membrane disposed in or on said pile of objects.

19. A method in accordance with claim 14 further comprising emplacing cement as a wet cement matrix during construction of said pile of objects.

20. A method in accordance with claim 14 wherein said second canopy is immediately adjacent said first canopy.

* * * * *